US008015921B2

(12) United States Patent
Leppanen et al.

(10) Patent No.: US 8,015,921 B2
(45) Date of Patent: Sep. 13, 2011

(54) ELECTRONIC BLASTING CAPSULE

(75) Inventors: Jarmo Leppanen, East Rand (ZA); Ockert Oosthuizen, East Rand (ZA)

(73) Assignee: Sandvik Mining and Construction RSA (PTY) Ltd., East Rand (ZA)

( * ) Notice: Subject to any disclaimer, the term of this patent is extended or adjusted under 35 U.S.C. 154(b) by 0 days.

(21) Appl. No.: 12/677,026

(22) PCT Filed: Sep. 8, 2008

(86) PCT No.: PCT/ZA2008/000080

§ 371 (c)(1), (2), (4) Date: Aug. 13, 2010

(87) PCT Pub. No.: WO2009/082767

PCT Pub. Date: Jul. 2, 2009

(65) Prior Publication Data

US 2010/0300317 A1 Dec. 2, 2010

(30) Foreign Application Priority Data

Sep. 10, 2007 (ZA) ..... 2007/08012

(51) Int. Cl.

| | |
|---|---|
| ***F42B 3/00*** | (2006.01) |
| ***F42B 3/10*** | (2006.01) |
| ***F42D 3/04*** | (2006.01) |

(52) U.S. Cl. ..... 102/313; 102/319; 299/13; 166/297; 166/299

(58) Field of Classification Search ..... 102/301, 102/312, 313, 314, 319, 322; 299/13; 166/297, 166/299

See application file for complete search history.

(56) References Cited

U.S. PATENT DOCUMENTS

| | | | | |
|---|---|---|---|---|
| 3,420,176 | A | 1/1969 | Pope | |
| 4,572,288 | A * | 2/1986 | Kinley | 166/63 |
| 5,369,579 | A | 11/1994 | Anderson | |
| 5,803,551 | A | 9/1998 | McCarthy | |
| 2005/0045331 | A1 | 3/2005 | Lerche | |
| 2008/0236433 | A1 | 10/2008 | Leppanen | |

FOREIGN PATENT DOCUMENTS

| | | |
|---|---|---|
| EP | 1338758 | 8/2003 |
| GB | 2411222 | 8/2005 |
| WO | 2006055953 | 5/2006 |
| WO | 2006099637 | 9/2006 |
| WO | 2009083644 | 7/2009 |

* cited by examiner

*Primary Examiner* — James Bergin

(74) *Attorney, Agent, or Firm* — Fitch, Even, Tabin & Flannery; Norman N. Kunitz

(57) ABSTRACT

An electronic blasting capsule which includes a housing which contains a propellant, a fuse, a sensor for detecting the position of the housing in a capsule delivery path, an energy arrangement for obtaining energy from an external energy source, and a controller, responsive to the sensor and the energy arrangement, for firing the fuse to initiate the propellant.

13 Claims, 3 Drawing Sheets

ELECTRONIC BLASTING CAPSULE

CROSS-REFERENCE TO RELATED APPLICATIONS

This is a U.S. National Phase of International Application PCT/ZA2008/000080, filed Sep. 8, 2008, and claims the benefit of priority under 35 U.S.C. §119 based on South African Application No. 2007/08012, filed Sep. 10, 2007, the entire disclosures of which applications are hereby incorporated herein by reference.

BACKGROUND OF THE INVENTION

This invention relates to an electronic blasting capsule.

The specification of international patent application number PCT/ZA2006/000037 describes a drilling machine which uses a drill bit, attached to a drill rod, to drill a hole in a rock face. The drill rod and drill bit are left in situ in the hole and a pressurised source is used to direct a propellant cartridge along passages in the drill rod and drill bit. In one situation the cartridge is ignited by causing the cartridge to impact against a wall of the hole. This can be somewhat unreliable.

It is known in the technology field which relates to missiles, shells and other projectiles, to transfer energy to a fuse on a projectile using a microwave or other suitable electromagnetic energy source. In U.S. Pat. No. 4,495,851 two-way communication is established between a shell and a control location in order to set and monitor the operation of an electronic fuse. U.S. Pat. No. 4,237,789 describes a projectile fuse which has electronic circuitry for receiving radiated signals. The fuse includes a fusible link which alters the operation of control circuitry. The projectile has no on-board intelligence and the link is fused in order to arm the projectile. U.S. Pat. No. 4,144,815 also relates to a fuse, in a projectile, which is set by a remote microwave source. One-way communication is established from a control to the projectile and circuitry associated with the fuse is biased so that it can subsequently receive data.

U.S. Pat. No. 4,160,416 makes use of an electromagnetic induction technique to transmit a signal to timing circuitry on a projectile which, apart from timing circuitry, has no on-board intelligence. U.S. Pat. No. 4,300,452, which also makes use of magnetic induction, describes the geometry of a suitable inductive link.

U.S. Pat. No. 4,632,031 refers to the remote arming of a projectile or missile. Optical communication is established with the projectile in order to program or operate a timing mechanism. U.S. Pat. No. 3,760,732 describes a system which makes use of RF signals, not magnetic coupling, to establish one-way communication with a projectile.

Other documents which are representative of the prior art, in this respect, are EP 1559986, EP 134298, U.S. Pat. No. 6,760,992, WO 2006055953, EP 235478, WO 20060702039, DE 4302009, U.S. Pat. No. 6,543,362 and EP 1126233.

Techniques in the prior art documents referred to are not suitable for use with a blasting capsule which can be initiated in a reliable and safe manner and which is suitable for use in a drilling machine of the aforementioned kind. An object of the invention is to provide a capsule of this type in which the likelihood of inadvertent ignition is reduced.

SUMMARY OF THE INVENTION

The invention provides an electronic blasting capsule which includes a cartridge, a propellant in the cartridge, an initiating device, an energy storage arrangement, a sensor for generating a signal which is dependent on the position of the capsule as it is moved along a predetermined path, and a controller which, in response to the signal, controls the supply of energy from the energy storage arrangement to fire the initiating device and so initiate the propellant.

The capsule may include an electronic switch which is closed by the controller, under controlled conditions, to fire the initiating device.

The energy storage arrangement may include an energy storage device which is used to power the controller and to provide energy to fire the initiating device. The energy storage device may comprise a capacitor.

The capsule may include an energy input device which is used to transfer energy to the energy storage arrangement. The energy input device may function in any appropriate way. In a preferred embodiment the energy input device is inductively coupled to an external energy source to obtain energy which is transferred to the energy storage arrangement. Preferably the quantity of energy which is transferred to the energy input device, per cycle of the external energy source, is limited.

The initiating device, which may be a suitable fuse, is thus fired only by energy which is transferred from the external energy source.

The sensor may be of any appropriate kind and for example may be inductive or capacitive. The sensor may be responsive to any external marker, material or object. Preferably one or more markers form part of, and are built into, the predetermined path and the sensor is responsive, at least, to such markers.

The capsule may include a memory in which digital data, relating to the predetermined path, is stored before the capsule is moved along the path. Such data may include, at least information which is indicative of one or more specific locations on the path. Data, which identifies a location at which the capsule is to be used, may also be stored in the memory.

The signal generated by the sensor may be compared to data in the memory to validate the use of the capsule and to verify and control the operation of the controller.

The capsule may include a timer for causing the firing of the initiating device a predetermined time after a signal of a particular nature is generated by the sensor.

The controller may prevent firing of the initiating device if the capsule is on the predetermined path for a period in excess of a predetermined duration, or fails to reach a particular point on the path within a predetermined time.

The invention also extends to a blasting arrangement which includes a drilling machine, a drill rod and a drill bit connected to the drilling machine, a pressurized source for directing a cartridge through passages in the drill rod and drill bit, and an external control unit which contains an external energy source and wherein the external control unit is used to transfer, at least, timing information to the capsule to control firing thereof.

The external control unit may also be used to transfer energy to the capsule for firing the capsule.

BRIEF DESCRIPTION OF THE DRAWINGS

The invention is further described by way of example with reference to the accompanying drawings in which.

DESCRIPTION OF PREFERRED EMBODIMENT

The present invention is described in the context of the disclosure in the specification of international patent application number PCT/ZA2006/000037 the content of which is hereby incorporated, to the extent which may be necessary for an understanding of the present invention, into this specification. Although the present invention is described in the context of the aforegoing international patent specification it is to be understood that this is by way of example only and is non-limiting. Thus the principles of the invention can be used in other applications.

In the invention described in the specification of the international application a rock drill is used to drill a hole in a rock face. A propellant cartridge is then fed along a cartridge delivery path which extends from a cartridge magazine along a passage inside a drill shank into a passage inside a drill bit. The cartridge is caused to move by water flow. The water flow rate is high and the cartridge is caused to impact an initiating or firing device at a limiting position inside the drill bit. When this happens the cartridge is fired. The water which is in the drill hole, and the drill shank, provide good stemming for a pressure wave generated upon detonation of the cartridge.

The present invention is concerned with a capsule which can be used in this type of application in a more reliable manner. As stated though the use of the invention is not confined to this particular application which is given for exemplary reasons only.

Figure 1:
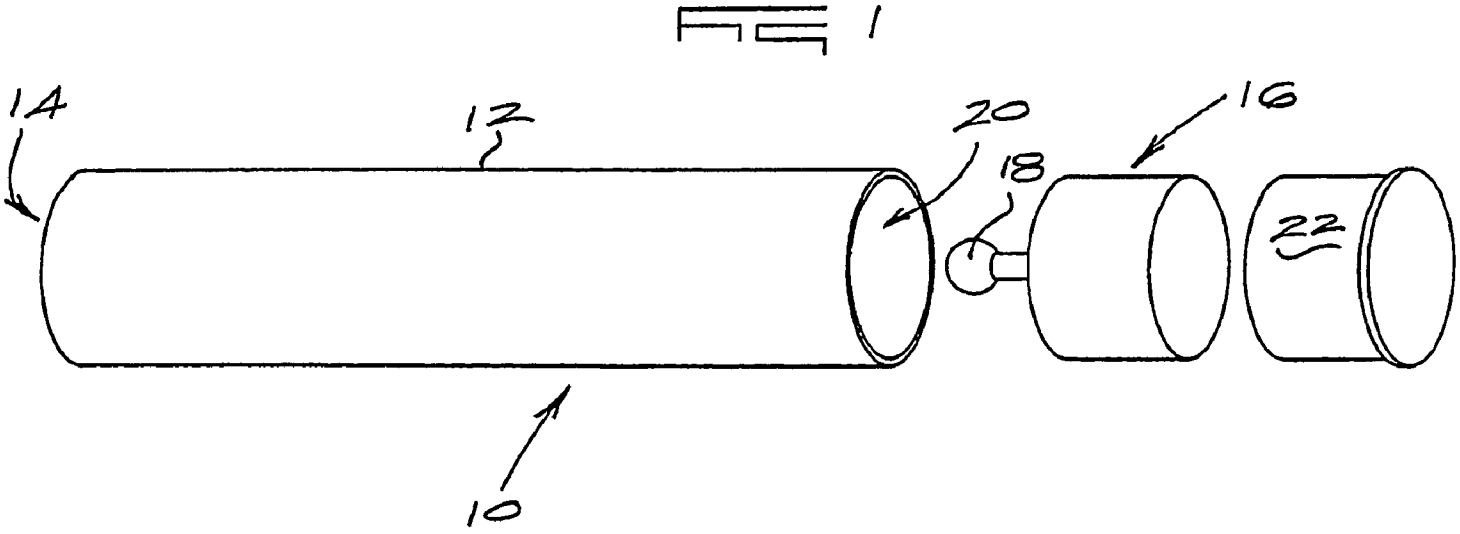
FIG. 1 is a side view of a capsule according to the invention illustrating its physical construction.

FIG. 1 of the accompanying drawings is an exploded view which illustrates the physical construction of a capsule 10 according to the invention.

The capsule includes a tubular housing 12 which contains a propellant (not shown). The housing is sealed at one end 14 by any suitable means. A casing 16 contains electronics and an initiating device such as a fuse 18 is attached to and extends from the casing which is adapted to be inserted into a mouth 20 of the tubular housing. Once this has been done the casing is held in position by means of an end cap 22 which is engaged with the mouth. The tubular housing 12 can be sealed against the ingress of water if necessary. The propellant is any suitable explosive, propellant or other energetic material.

Figure 2:
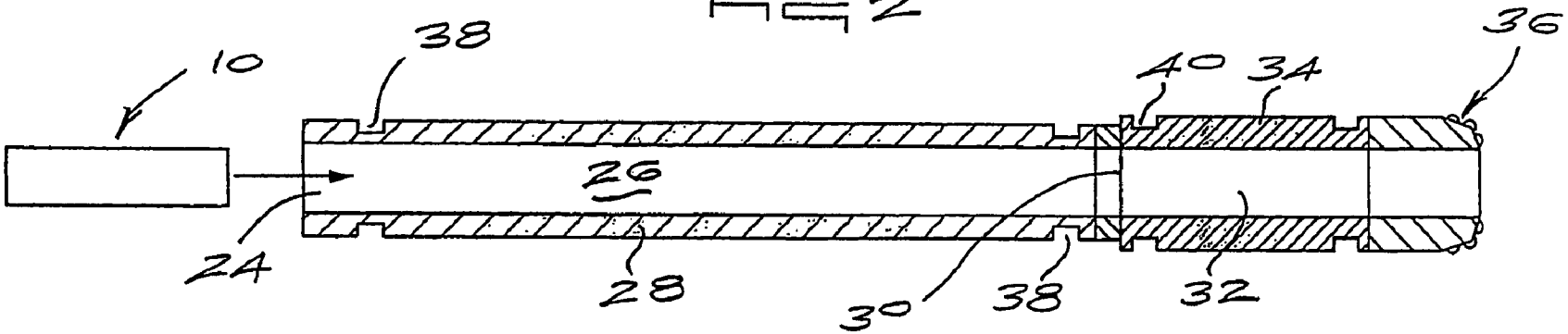
FIG. 2 shows the capsule of FIG. 1 entering a rock drill shank.

The capsule 10 is adapted to be delivered to a blasting position inside a hole in a rock face (not shown) by means of high pressure water which forces the capsule to travel along a predetermined path formed by inter-leading passages in a rock drill shank and a drill bit. This process is schematically represented in FIG. 2 which shows a capsule 10 at an entry port 24 to a passage 26 inside a shank 28 of a rock drill. The passage terminates at an exit port 30 which is in communication with a second passage 32 which is formed inside a rock drill bit 34. The bit has a drilling head 36 with a central bore.

The shank 28 has one or more undercut formations 38 at strategic positions. Similarly the drill bit 34 has one or more undercut formations 40 at strategic positions.

The shank, drill bit and drilling head are made from different materials and thus, inherently, have different electromagnetic properties or characteristics.

Figure 3:
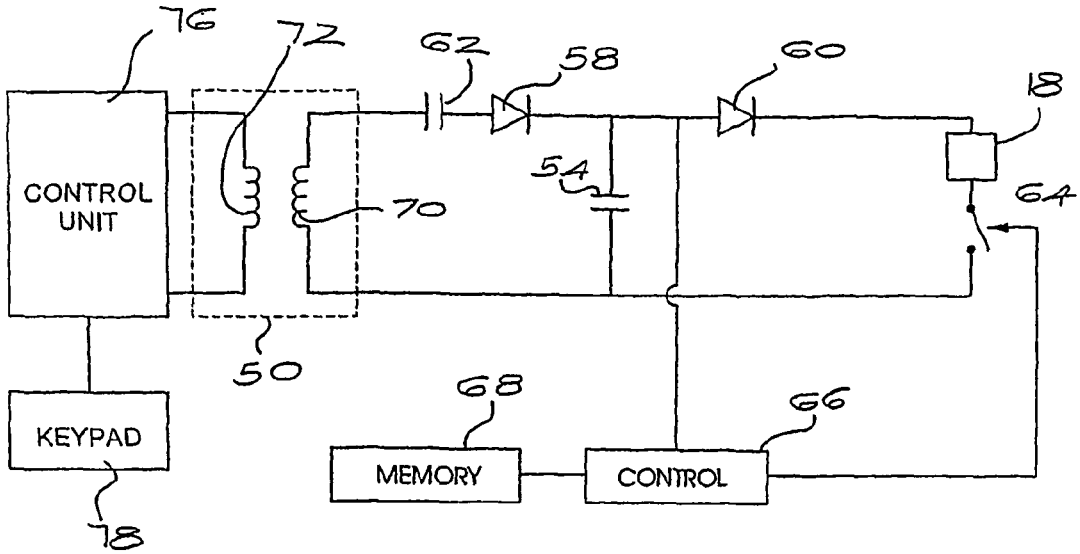
FIG. 3 shows an electronic circuit which is used in the capsule, coupled to an internal control unit.
Figure 4:
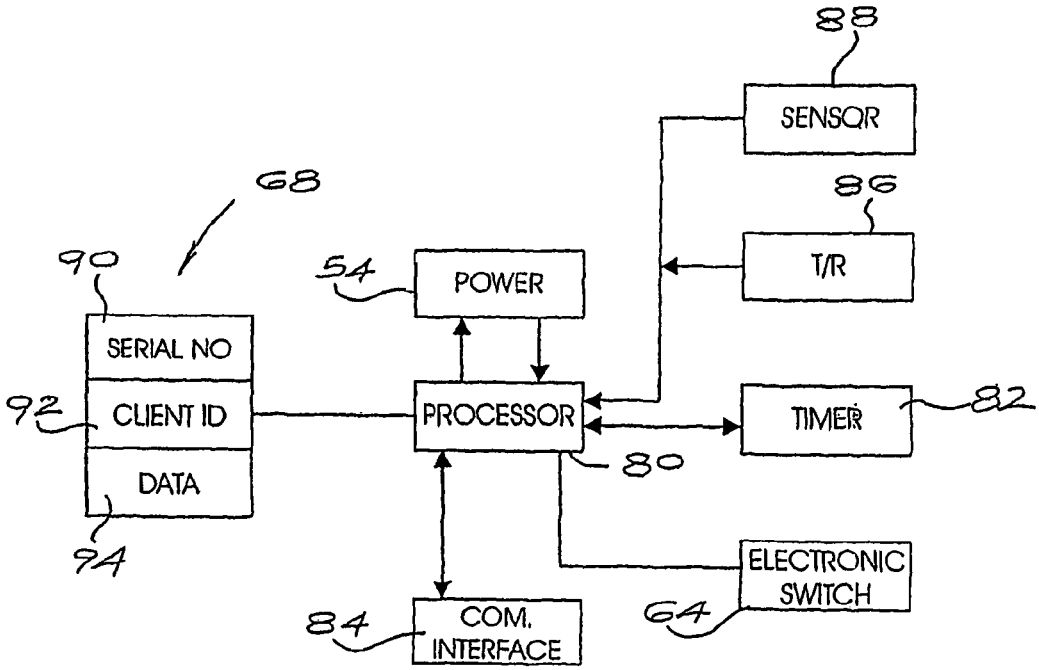
FIG. 4 is a block diagram representation of components associated with a controller used in the capsule of the invention.

The casing 16 contains electronic circuitry of the kind shown in FIGS. 3 and 4. The conceptual basis of the invention is readily understood with reference to FIG. 3 which illustrates an energy source 50, the fuse 18 (i.e. the initiating device), a capacitor 54, diodes 58 and 60 respectively, an energy limiting capacitor 62 and an electronic switch 64. The operation of the switch is under the control of a controller 66, inside the casing, which has an internal memory 68. The energy source 50 comprises a secondary inductive coil 70 which is associated with the casing 16 and a primary coil 72 which is positioned in a magazine (not shown) of the drilling machine at a location immediately upstream of the inlet port 24 shown in FIG. 2.

The primary coil is controlled by an external control unit 76 which, preferably, is uniquely associated with the rock drill shank 28. The control unit 76 can for example be physically fixed to the rock drill shank, or it can be linked thereto in any other way e.g. electronically, by use of codes, electronic keys, or the like. The control unit 76 has a programmable processor and memory, and is connected to an input device such as a keyboard 78 so that operation of the control unit can be controlled by an operator. For example, timing information which is dependent on the nature of the cartridge, the type of rock to be blasted, etc. is entered into and stored in the control unit. Other data in the control unit which preferably is preprogrammed under factory conditions into the control unit includes identity data relating to the rock drill and to the operator or owner of the rock drill. This data can be used to regulate operation of the rock drill, to keep track of the cartridges and the use of the rock drill, and for other security and safety purposes.

If the capsule is positioned so that the coils 70 and 72 are electromagnetically linked and the primary coil 72 is energised with a suitable high frequency signal then a corresponding signal is induced in the secondary coil 70. The capacitor 62 allows only a limited quantity of energy to flow through it per cycle of the energising signal. The diode 58 rectifies the alternating signal and the capacitor 54 is charged.

As is described in more detail hereinafter, the energy in the capacitor 54 is initially used to power the controller 66 which, under the effect of suitable software, executes a number of validation routines and safety procedures and monitors the passage of the capsule in the capsule delivery path which is formed in the rock drill shank. If all the preliminary processes are correctly carried out, and if the cartridge reaches its operative position as scheduled, then the remaining energy in the capacitor 54 is used, at a predetermined time, to fire the fuse 18—this is caused by closure of the switch 64 which allows the capacitor 54 to discharge its load through the fuse and ignite the propellant.

The time required to charge the capacitor 54 to working voltage is short, of the order of 0.6 seconds. Once the capacitor is fully charged the control unit 66 executes a self-calibration routine during which a number of self-tests and calibration procedures are carried out. This is done in a few milliseconds. If the self-calibration routine is successfully executed then the control unit 66 generates an appropriate message which is transmitted, using the coil 70 as an antenna and the coil 72 as a receiving antenna, to the external control circuit 76. At the same time an identity number for the capsule in question, taken from the memory 68, is transmitted.

If the external control unit validates the information then an arm instruction is issued to the controller 66. It is not possible therefore to arm an "unauthorised" capsule for its identity number or serial number cannot be validated.

FIG. 4 illustrates in block diagram form various components of the controller 66 required for implementing the aforementioned steps. The controller includes a processor 80 which, as noted, is powered by energy contained in the capacitor 54. The processor controls a timing module 82 and is connected to an optional communication interface 84. The processor is also connected to a transmit/receive module 86 which in turn is connected to the secondary coil 70. This coil also functions as an inductive sensor 88. The memory 68 includes data necessary for the operation of the capsule. Without being limiting this data includes a serial number 90 for the capsule in question, an identity number 92 which identifies the client or customer who acquired the capsule, and data 94 which is required for the self-test and calibrate routines. Positional data which relates to defined positions in the rock drill shank, is also included in the stored data. This positional data is extracted and determined beforehand for the particular rock drill by using suitable sensors and probes and is dependent, inter alia, on the material or materials from which the shank is made, and dimensional aspects of the shank. The relevant data is loaded into the memory under factory conditions, i.e. prior to delivery of the capsule to the customer in question, in an initial step 96, see FIG. 5.

The secondary coil 70 is capable of functioning at least in three modes. Firstly, it forms part of the energy source 50 and provides a means whereby the electronic circuit can be powered. Secondly, the coil functions as a transmit/receive antenna in communications to be effected between the external control unit 76 and the electronics on board the capsule. Thirdly, the coil 70 functions as a sensor to control the firing operation of the capsule, as is described hereinafter.

Figure 5:
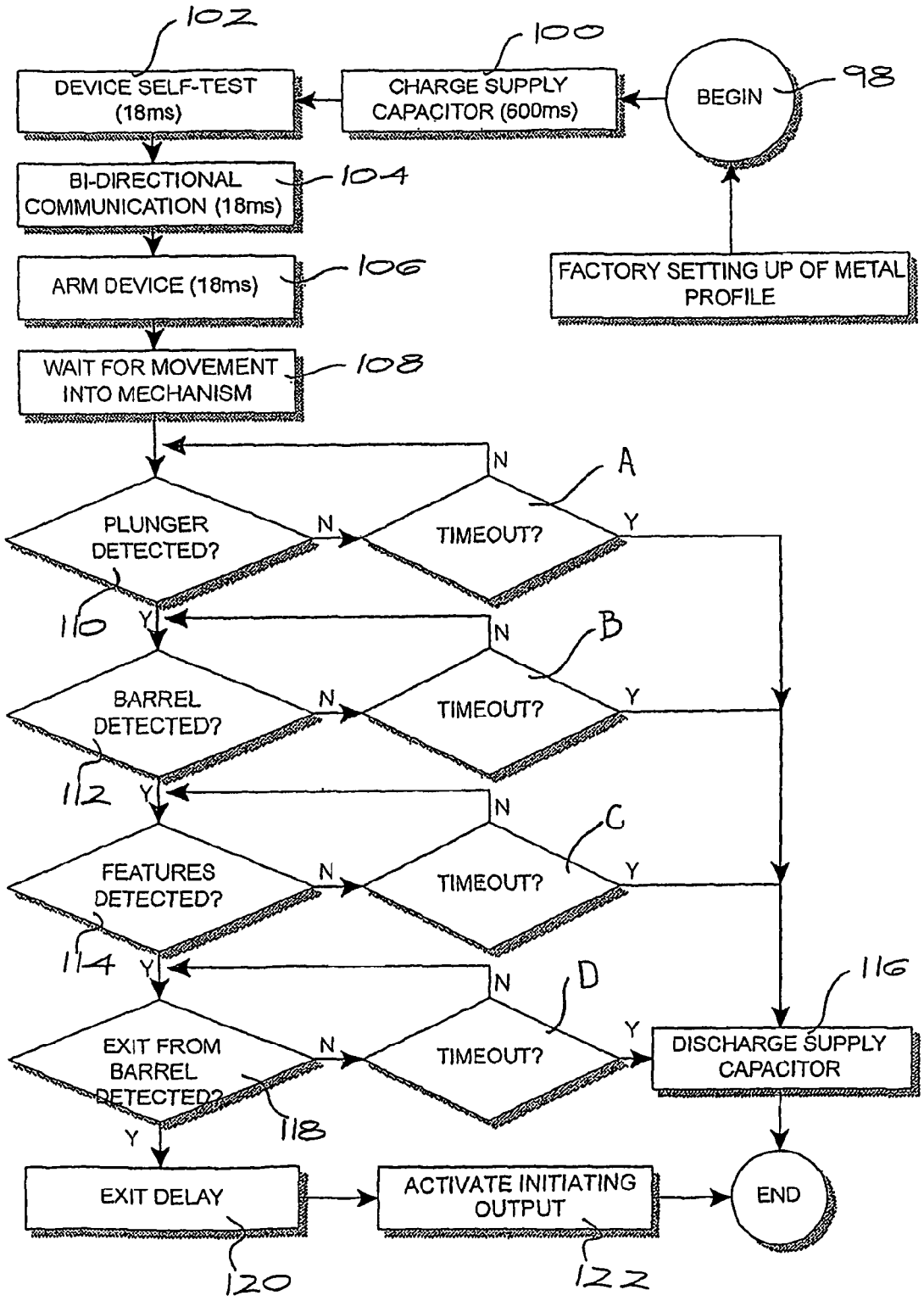
FIG. 5 is a flowchart of operations carried out in controlling the operation of the blasting capsule of the invention.

FIG. 5 is a flow chart of a sequence of operations carried out during use of the capsule. With the capsule at the entry port 24 (step 98—FIG. 5) the secondary coil 70 is electromagnetically coupled to the primary coil 72 connected to the external control unit 76. The primary coil is energised with a high frequency carrier signal which induces a secondary signal in the secondary coil 70. The capacitor 62 allows only a limited amount of energy per cycle of the excitation voltage to flow to the diode 58. This diode rectifies the alternating current and the capacitor 54 is then charged, effectively in successive steps each of which results from the quantity of energy which passes through the capacitor 62 per cycle. The charging of the capacitor 54 takes about 600 milliseconds (step 100).

The controller 66 senses when the capacitor 54 is fully charged and, when this occurs, initiates a self-calibration routine (step 102) during which a number of self-tests and calibration processes are carried out. This is done in a few milliseconds.

The processor 80 then accesses the client data 92 and transmits this data together with a message indicating that the calibration routine was successfully carried out (step 104). In response thereto the external control unit issues an arm signal (step 106). However if the self-test routine was not successful then the control unit issues an appropriate signal which aborts the firing or attempted firing of the capsule 10.

The capsule, once it has received the arm signal, is held at the entry port 24 and waits for movement into the mechanism (step 108). The capsule, at this stage, is handled in accordance with the process described in the specification of the international patent application referred to. Thus when a firing process is to be initiated the capsule is moved by a plunger, not shown, away from the primary coil or transmitter loop 72. The consequent electromagnetic decoupling of the primary and secondary coils results in a change in the signal which is detected by the secondary coil 70 acting as a sensor (step 110). The capsule is then moved into the shank or barrel 28 shown in FIG. 2 and this is immediately detected by the secondary coil 70 which is responsive to the increase of electromagnetic material to which the winding is exposed (step 112).

The capsule is then caused to move along the passage 26 by means of water flow from an external pressurised source of water (not shown). During this movement the secondary coil 70 is responsive to the surrounding electromagnetic material. Any significant change in the composition or thickness of the surrounding electromagnetic material results in a corresponding change in a signal which is output by the secondary coil 70 which, in this respect, acts as a sensor. The output signal of the coil 70 is also dependent on the speed of movement of the capsule through the passage but, to a substantial extent, the speed is constant to such a degree that changes in the signal due to variations in the electromagnetic material are dominant compared to changes in the signal which arise as a consequence of speed changes. The processor 80 is therefore capable of detecting features in the shank 28 as the capsule moves along the passage 26 (step 114).

All detected features are compared immediately to the corresponding data pre-programmed in the controller 66 to verify that the operational sequence is being correctly carried out. Any unsuccessful test or operation, in the steps leading up to firing of the capsule, results in the testing of the duration of a relevant timing period (steps A, B, C and D) which, if exceeded, causes the supply capacitor 54 to be discharged fully (step 116) so that the operational sequence is thereby aborted.

When the capsule reaches the exit port 30 of the passage 26 another distinctive signal is generated to indicate this event (step 118). The signal can arise as a result of the different materials and because of varying thicknesses of materials from which the shank and drill bit are made. It is also possible to engineer formations into the shank to accentuate different predetermined positions. For example the undercut formations 38 which are formed at strategic locations in the shank, will give rise to distinct signals as the capsule passes these undercut formations. Similarly, when the capsule is in the drill bit 34, the undercut formations 40 will give rise to distinct signals as the secondary coil 70 passes these formations. Similar effects can be achieved by altering the materials through which the cartridge passes.

When the processor 80 detects that the capsule has entered the drill bit, the processor 80 initiates a timing interval (step 120) using the timer 82. The duration of the timing interval can be set or pre-programmed and, for example, can vary from 0 to 120 seconds. At the end of this interval the processor causes the electronic switch 64 to close and the remaining energy in the capacitor 54 is then discharged through the fuse 18, which is initiated (step 122). The propellant in the cartridge is thereby fired.

As indicated, if the time interval between the capsule entering the passage 26 at the entry port 24 and leaving the passage at the exit port 30 is of more than a predetermined duration, say 45 seconds, then the processor 80 interprets this as an error condition and it causes the capacitor 54 to be discharged (step 116) but without energy reaching the fuse 18. The cartridge is then rendered inactive or dormant.

In one respect the invention is based on the capability of the capsule to sense the amount of metal in the area in which the capsule is. This makes it possible for the processor to be programmed to look for a number of distinct physical features as it is moved inside the drilling machine and along the drill shank and drill bit. The capsule is therefore able, independently, to ascertain its physical position in the drilling machine and initiation of the propellant in the capsule is made dependent thereon.

The capsule is usually completely without power and is only powered immediately prior to its use in the manner which has been described. This aspect is used to provide a number of safety functions. For example the capsule has to go through a number of steps or phases before the fuse 18 can be initiated. If a phase is missed the processor 80 resets and the element 18 cannot be fired. The values which are sensed by the secondary coil 70 are compared to data collected beforehand, under test conditions, and stored in the memory 68. If the comparative process indicates an incorrect sequence or a discrepancy between a signal and stored data then, again, the capsule is reset.

The processor 80 is connected via a dedicated output to the electronic switch 64. This output is not used for any other function. This reduces the likelihood of a processing error giving rise to a firing signal on the dedicated output.

An important factor is that the capacitor 62 limits the quantity of energy which can be transferred by the secondary coil 70 to the remainder of the circuit. This means that even if the electronic switch 64 is faulty and is kept permanently closed the low current which passes through the fuse and which is limited by the quantity of energy passed per cycle by the capacitor 62, is insufficient to fire the fuse 18. Other safety factors include the following:

(1) if the energy source 50 is faulty there will be insufficient energy in the system to fire the fuse 18;

(2) if the capacitor 54 is faulty, or if either diode 58 or 60 is open then there will be insufficient energy to fire the fuse 18;

(3) if the capacitor 54 is short circuited then there will be no energy to fire the fuse 18;

(4) if the capacitor 54 is open circuited then there is no energy to operate the control unit 66; and (5) if, during a charging routine, the switch 64 is closed then the capacitor 54 continuously discharges at a rate which is not sufficient to fire the fuse 18. The control circuit 66 checks the operating voltage output by the capacitor 54 and if this is too low then the self-test routine (step 102) will indicate a malfunction. An arm instruction will then not be generated.

If, for any reason, the fuse 18 fails to initiate then the capacitor 54 is discharged by the controller 66. Energy from the capacitor is directed in the form of pulses, by the controller 66, rapidly into the winding 70. This dissipates the energy and the capacitor is discharged in a short period e.g. of the order of one second.

The capsule of the invention is thus electronically controlled to fire a predetermined time interval after reaching a predetermined position en route to a firing location. The predetermined position can be varied and so can the duration of the predetermined time interval. Firing is not dependent on a mechanical impact between the capsule and an external firing device. A large number of safety features can be incorporated into the capsule.

The invention claimed is:

1. An electronic blasting capsule for use in a borehole formed by a drill rod and a drill bit which includes a cartridge, and within the cartridge, a propellant, an initiating device, an energy storage arrangement, a sensor for generating a signal which is dependent on the position of the cartridge as it is moved along a predetermined path within the drill rod and the drill bit, and a controller which, in response to the signal, controls the supply of energy from the energy storage arrangement to fire the initiating device and so initiate the propellant.

2. A capsule according to claim 1 which includes an electronic switch which is closed by the controller, under controlled conditions, to fire the initiating device.

3. A capsule according to claim 1 wherein the energy storage arrangement includes an energy storage device which is used to power the controller and to provide energy to fire the initiating device.

4. A capsule according to claim 1 wherein the sensor additionally acts as an energy input device which is inductively coupled to an energy source outside the borehole to obtain energy which is transferred to the energy storage arrangement, and wherein the quantity of energy which is transferred to the energy input device, per cycle of the external energy source, is limited.

5. A capsule according to claim 4 wherein the initiating device is fired only by energy which is transferred from the energy source.

6. A capsule according to claim 1 wherein the sensor additionally acts as a transmit/receive communication antenna.

7. A capsule according to claim 1 wherein the sensor is responsive to at least one marker in the predetermined path.

8. A capsule according to claim 1 which includes a memory in which digital data, relating to the predetermined path, is stored and wherein the data is selected at least from:

information which is indicative of one or more specific locations on the path, and data which identifies a location at which the cartridge is to be used.

9. A capsule according to claim 8 which includes a timer and wherein the signal from the sensor is compared to data in the memory to control operation of the controller and to fire the initiating device a predetermined time after a signal of a particular nature is generated by the sensor.

10. A capsule according to claim 1 wherein the controller includes software to prevent firing of the initiating device if the cartridge is on the predetermined path for a period in excess of a predetermined duration, or fails to reach a particular point on the path within a predetermined time.

11. A capsule according to claim 1 wherein the signal, generated by the sensor, is responsive to electromagnetic material in the drill rod and the drill bit.

12. A blasting arrangement which includes a drilling machine, a drill rod and a drill bit connected to the drilling machine, a capsule according claim 1, a pressurized source for directing the cartridge through passages in the drill rod and drill bit, wherein the sensor, in the cartridge, generates a signal which is dependent on the position of the cartridge in these passages, and an external control unit which contains an external energy source, and wherein the external control unit is used to transfer, at least, timing information to the controller to control firing of the propellant.

13. A blasting arrangement according to claim 12 wherein the external control unit transfers energy, from the external energy source, for firing the propellant.

* * * * *